US012305342B2

(12) United States Patent
Xu et al.

(10) Patent No.: US 12,305,342 B2
(45) Date of Patent: May 20, 2025

(54) NOISE REDUCING RESONATOR IN A SURFACE COMPACTION MACHINE

(71) Applicant: Volvo Construction Equipment AB, Eskilstuna (SE)

(72) Inventors: Hongan Xu, Mechanicsburg, PA (US); David Clark, Mechanicsburg, PA (US)

(73) Assignee: Volvo Construction Equipment AB, Eskilstuna (SE)

( * ) Notice: Subject to any disclaimer, the term of this patent is extended or adjusted under 35 U.S.C. 154(b) by 438 days.

(21) Appl. No.: 17/770,496

(22) PCT Filed: Oct. 22, 2019

(86) PCT No.: PCT/IB2019/059028
§ 371 (c)(1),
(2) Date: Apr. 20, 2022

(87) PCT Pub. No.: WO2021/079169
PCT Pub. Date: Apr. 29, 2021

(65) Prior Publication Data

US 2022/0372714 A1 Nov. 24, 2022

(51) Int. Cl.
*E01C 19/28* (2006.01)
*F01N 1/02* (2006.01)

(52) U.S. Cl.
CPC ..... *E01C 19/286* (2013.01); *F01N 1/02* (2013.01)

(58) Field of Classification Search
CPC ..... E01C 19/28; E01C 19/286
See application file for complete search history.

(56) References Cited

U.S. PATENT DOCUMENTS

2018/0135515 A1 5/2018 Fung et al.

FOREIGN PATENT DOCUMENTS

| | | | | |
|---|---|---|---|---|
| CN | 208088063 | U | | 11/2018 |
| CN | 108978414 | A | | 12/2018 |
| CN | 109183567 | A | | 1/2019 |
| DE | 2315972 | A1 | | 10/1974 |
| EP | 3098413 | A1 | | 11/2016 |
| JP | 2013014984 | A | * | 1/2013 |
| JP | 107636272 | A | | 1/2018 |
| KR | 20190054589 | A | | 5/2019 |
| WO | 2020032974 | A1 | | 2/2020 |

OTHER PUBLICATIONS

First Office Action for Chinese Patent Application No. 201980101455.3, mailed Feb. 17, 2023, 12 pages.
International Search Report and Written Opinion of the International Searching Authority, PCT/IB2019/059028, mailed Jul. 28, 2020, 11 pages.

* cited by examiner

*Primary Examiner* — Anthony Ayala Delgado
(74) *Attorney, Agent, or Firm* — Sage Patent Group

(57) ABSTRACT

A resonator assembly for a surface compaction machine comprising a resonator housing (36) defining an internal cavity, the resonator housing comprising a first head plate (242) comprising a plurality of first cutouts (44); and a plurality of first extension tubes (246), wherein each first extension tube of the plurality of first extension tubes is coupled to the first head plate around a corresponding first cutout, wherein each first cutout forms an acoustic passage between the internal cavity and an exterior of the resonator housing to attenuate sound around the internal cavity.

20 Claims, 7 Drawing Sheets

NOISE REDUCING RESONATOR IN A SURFACE COMPACTION MACHINE

CROSS REFERENCE TO RELATED APPLICATIONS

This application is a 35 U.S.C. § 371 national stage application of PCT International Application No. PCT/IB2019/059028 filed on Oct. 22, 2019, the disclosure and content of which is incorporated by reference herein in its entirety.

FIELD

Embodiments relate to a resonator, and more particularly to a noise-reducing resonator in a surface compaction machine.

BACKGROUND

Surface compaction machines are used to compact a variety of substrates including soil, asphalt, or other materials. Surface compaction machines are provided with one or more compacting surfaces for this purpose. For example, a surface compaction machine, such as a roller compactor, may be provided with one or more cylindrical drums that provide compacting surfaces for compacting substrates.

Roller compactors use the weight of the compactor applied through rolling drums to compress a surface of the substrate being rolled. In addition, one or more of the drums of some roller compactors may be vibrated by a vibration system to induce additional mechanical compaction of the substrate being rolled. The vibration system of these surface compaction machines can include an eccentric vibration system that includes an eccentric mass that is rotated to generate a vibration force which increases the compacting force exerted by the drum.

These and other vibration systems may produce undesirable noise during operation of the surface compaction machine. For example, known surface compaction machines typically produce noise at frequencies ranging between about 30 Hz to about 80 Hz for eccentric vibration systems, about 60 Hz to about 400 Hz for engine noise, about 300 Hz to about 2000 Hz for fan noise (airborne), and about 200 Hz to about 3000 Hz for hydraulic noise (fluid-borne), with the specific frequencies varying based on machine size, the type of material being compacted, and other factors. While this noise may be reduced by reducing the amplitude and/or speed of the vibration system, this is undesirable because the compaction efficiency of the surface compaction machine would also be reduced.

SUMMARY

According to an embodiment, a resonator assembly for a surface compaction machine is disclosed. The resonator assembly includes a resonator housing defining an internal cavity, the resonator housing having a first head plate comprising a plurality of first cutouts. The resonator assembly further includes a plurality of first extension tubes. Each first extension tube of the plurality of first extension tubes is coupled to the first head plate around a corresponding first cutout. Each first cutout forms an acoustic passage between the internal cavity and an exterior of the resonator housing to attenuate sound around the internal cavity.

According to an embodiment, a drum assembly for a surface compaction machine is disclosed. The drum assembly includes a substantially cylindrical drum housing comprising an external compaction surface and an internal surface opposite the external compaction surface. The drum assembly further includes a first head plate coupled to the internal surface of the drum housing. The drum assembly further includes a second head plate coupled to the internal surface of the drum housing. The drum assembly further includes an eccentric vibration system housing coupled between the first head plate and the second head plate. The compaction surface, the first head plate, the second head plate, and the eccentric vibration system housing form a substantially annular internal resonator cavity. The drum assembly further includes a plurality of cutouts in the first head plate and the second head plate. The drum assembly further includes a plurality of extension tubes coupled to the first head plate and the second head plate, wherein each extension tube is coupled around a corresponding cutout to form an acoustic passage between the internal resonator cavity to attenuate sound around the internal resonator cavity.

Other devices, methods, and systems according to embodiments will be or become apparent to one with skill in the art upon review of the following drawings and detailed description. It is intended that all such additional surface compaction machines, methods, and control systems be included within this description and protected by the accompanying claims. Moreover, it is intended that all embodiments disclosed herein can be implemented separately or combined in any way and/or combination.

ASPECTS

According to an aspect, a resonator assembly for a surface compaction machine is disclosed. The resonator assembly includes a resonator housing defining an internal cavity, the resonator housing having a first head plate comprising a plurality of first cutouts. The resonator assembly further includes a plurality of first extension tubes. Each first extension tube of the plurality of first extension tubes is coupled to the first head plate around a corresponding first cutout. Each first cutout forms an acoustic passage between the internal cavity and an exterior of the resonator housing to attenuate sound around the internal cavity.

According to an aspect, the resonator housing further includes a second head plate opposite the first head plate, wherein the second head plate includes a plurality of second cutouts. The resonator housing further includes a plurality of second extension tubes, wherein each second extension tube of the plurality of second extension tubes is coupled to the second head plate around a corresponding second cutout. The resonator housing further includes a drum housing including a substantially cylindrical compaction surface surrounding the first head plate and the second head plate. The internal cavity includes a substantially cylindrical cavity defined by the first head plate, the second head plate, and the drum housing.

According to an aspect, the resonator assembly further includes an eccentric vibration system housing for enclosing an eccentric vibration system, wherein the internal cavity surrounds the eccentric vibration system.

According to an aspect, at least two first cutouts of the plurality of first cutouts have different sizes.

According to an aspect, each first extension tube of the plurality of first extension tubes has a cross-sectional area substantially equal to the size of the first cutout corresponding to the first extension tube.

According to an aspect, at least two first extension tubes of the plurality of first extension tubes have different lengths.

According to an aspect, a first subset of the plurality of first extension tubes extends into the internal cavity in a first direction. A second subset of the plurality of first extension tubes extends away from the internal cavity in a second direction.

According to an aspect, the first head plate includes a non-removable structural plate coupled to the resonator housing and a removable cover plate removably coupled to the structural plate.

According to an aspect, each first cutout includes a structural plate cutout and a corresponding cover plate cutout that is smaller than the structural plate cutout. Each first extension tube has a cross sectional area that is substantially coincident with the cover plate cutout corresponding to the first extension tube.

According to an aspect, each first extension tube of the plurality of first extension tubes is coupled to the cover plate around the cover plate cutout corresponding to first extension tube.

According to an aspect, the removable cover plate includes a plurality of removable cover plates. Each removable cover plate is removably coupled to the structural plate around a corresponding structural plate cutout.

According to an aspect, the internal cavity, the first cutouts and the first extension tubes are sized to attenuate sound in one or more predetermined frequency ranges.

According to an aspect, the predetermined frequency range is between about 30 Hz and 80 Hz.

According to an embodiment, a drum assembly for a surface compaction machine is disclosed. The drum assembly includes a substantially cylindrical drum housing comprising an external compaction surface and an internal surface opposite the external compaction surface. The drum assembly further includes a first head plate coupled to the internal surface of the drum housing. The drum assembly further includes a second head plate coupled to the internal surface of the drum housing. The drum assembly further includes an eccentric vibration system housing coupled between the first head plate and the second head plate. The compaction surface, the first head plate, the second head plate, and the eccentric vibration system housing form a substantially annular internal resonator cavity. The drum assembly further includes a plurality of cutouts in the first head plate and the second head plate. The drum assembly further includes a plurality of extension tubes coupled to the first head plate and the second head plate, wherein each extension tube is coupled around a corresponding cutout to form an acoustic passage between the internal resonator cavity to attenuate sound around the internal resonator cavity.

According to an aspect, at least two cutouts of the plurality of cutouts have different sizes.

According to an aspect, each extension tube of the plurality of extension tubes has a cross-sectional area substantially equal to the size of the cutout corresponding to the extension tube.

According to an aspect, at least two extension tubes of the plurality of extension tubes have different lengths.

According to an aspect, a first subset of the plurality of extension tubes extends into the internal cavity. A second subset of the plurality of extension tubes extends away from the internal cavity.

According to an aspect, the first head plate includes a non-removable first structural plate coupled to the drum housing and the eccentric vibration system housing and a removable first cover plate removably coupled to the first structural plate. The second head plate includes a non-removable second structural plate coupled to the drum housing and the eccentric vibration system housing a removable second cover plate removably coupled to the second structural plate.

According to an aspect, the internal resonator cavity, the cutouts and the extension tubes are sized to attenuate sound in one or more predetermined frequency ranges.

BRIEF DESCRIPTION OF THE DRAWINGS

The accompanying drawings, which are included to provide a further understanding of the disclosure and are incorporated in and constitute a part of this application, illustrate certain non-limiting embodiments of inventive concepts. In the drawings.

DETAILED DESCRIPTION OF EMBODIMENTS

Figure 1:
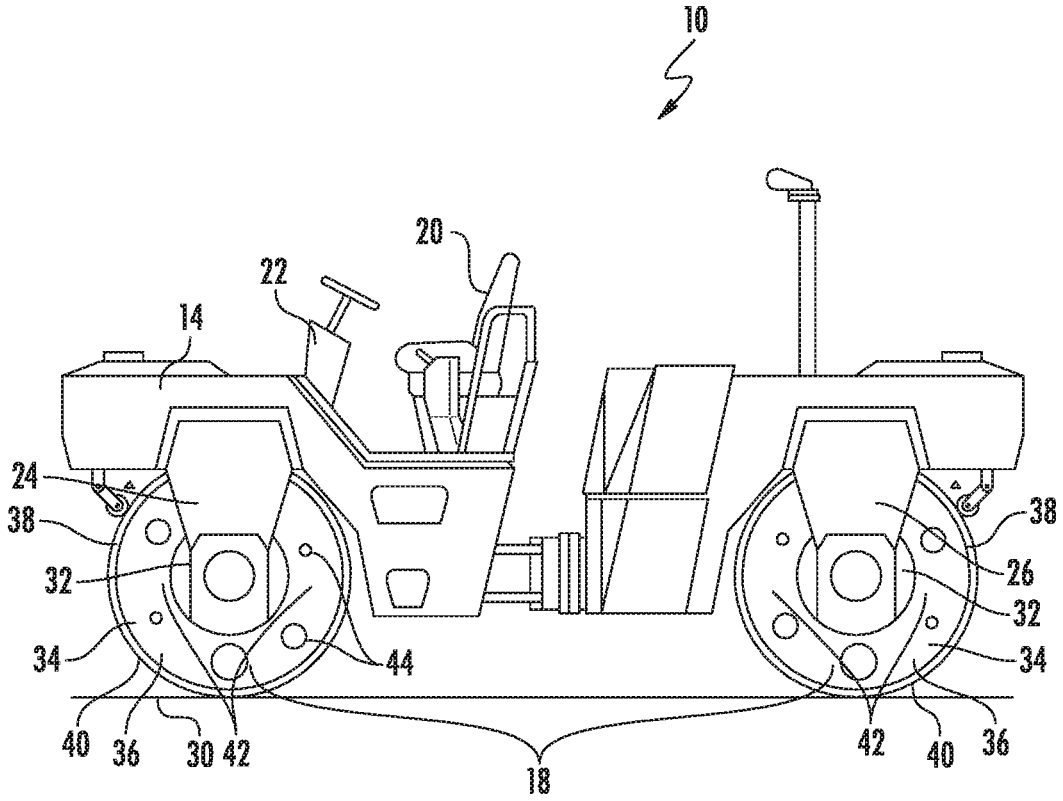
FIG. 1 illustrates a cross-sectional view of a self-propelled roller-type surface compaction machine having resonators in the drums to reduce noise, according to some embodiments.

FIG. 1 illustrates a cross-sectional view of a self-propelled roller-type surface compaction machine 10 according to some embodiments. The surface compaction machine 10, which may also be referred to herein as a vibratory compaction machine or a roller compactor, includes a body chassis structure 14, and rotatable drums 18 at the front and back of the body chassis structure 14. As shown, the body chassis structure 14 may include a driver station provided with a seat 20 and a steering mechanism 22 (e.g., a steering wheel) to provide driver control of the surface compaction machine 10. Moreover, each drum 18 may be coupled to the body chassis structure 14 using a respective yoke 24, 26. One or both of the drums 18 may be driven by a drive motor (not shown) to propel the surface compaction machine 10. The drums 18 have a cylindrical outer compaction surface 40 for compacting an underlying substrate 30, such as asphalt, gravel, soil, etc. Those of ordinary skill in the art will appreciate, however, that other types of surface compaction machines are contemplated, such as a surface compaction machine with a single drum, for example, or other types of surface compaction machines and other equipment that utilize directional vibration energy.

Those of ordinary skill in the art will appreciate that one or both of the drums 18 may include an eccentric vibration system 32 that rotates to generate vibration energy. The generated vibration energy causes the compaction surface 40 of the drum 18 to vibrate against the substrate 30 to aid in compacting the substrate 30. Other types of vibration systems may be used within the drum 18 and/or at other locations of the surface compaction machine 10, as well. The eccentric vibration system 32, and other vibration systems, are a significant source of unwanted noise. In many typical applications, this unwanted noise from the eccentric vibration system is in the 30-80 Hz range. Those of ordinary skill in the art will also appreciate that surface compaction machines 10 may have additional sources of unwanted noise, as well, such as the engine, cooling fans, hydraulic systems, or other sources (not shown).

In some embodiments, a resonator assembly 34 is formed in the drum 18 to reduce unwanted noise generated by the eccentric vibration system 32 and/or other components of the surface compaction machine 10. The resonator assembly 34 includes a resonator housing 36 that defines an internal cavity (shown in FIG. 2A). Each resonator housing 36 in some embodiments is formed by a substantially cylindrical drum housing 38 opposite the compaction surface 40 and a pair of head plates (shown in FIG. 2A) that provide structural support for the drum 18. The drum housing 38 and head plates define an internal cavity (shown in FIG. 2A). Each head plate has a plurality of cutouts 44 and a plurality of extension tubes (shown in FIG. 2A) coupled thereto. As will be described in greater detail below, each extension tube is coupled around a respective cutout 44 to form an acoustic passage between the internal cavity and an exterior of the resonator housing 36, which causes sound around the internal cavity to be attenuated.

Figure 2A:
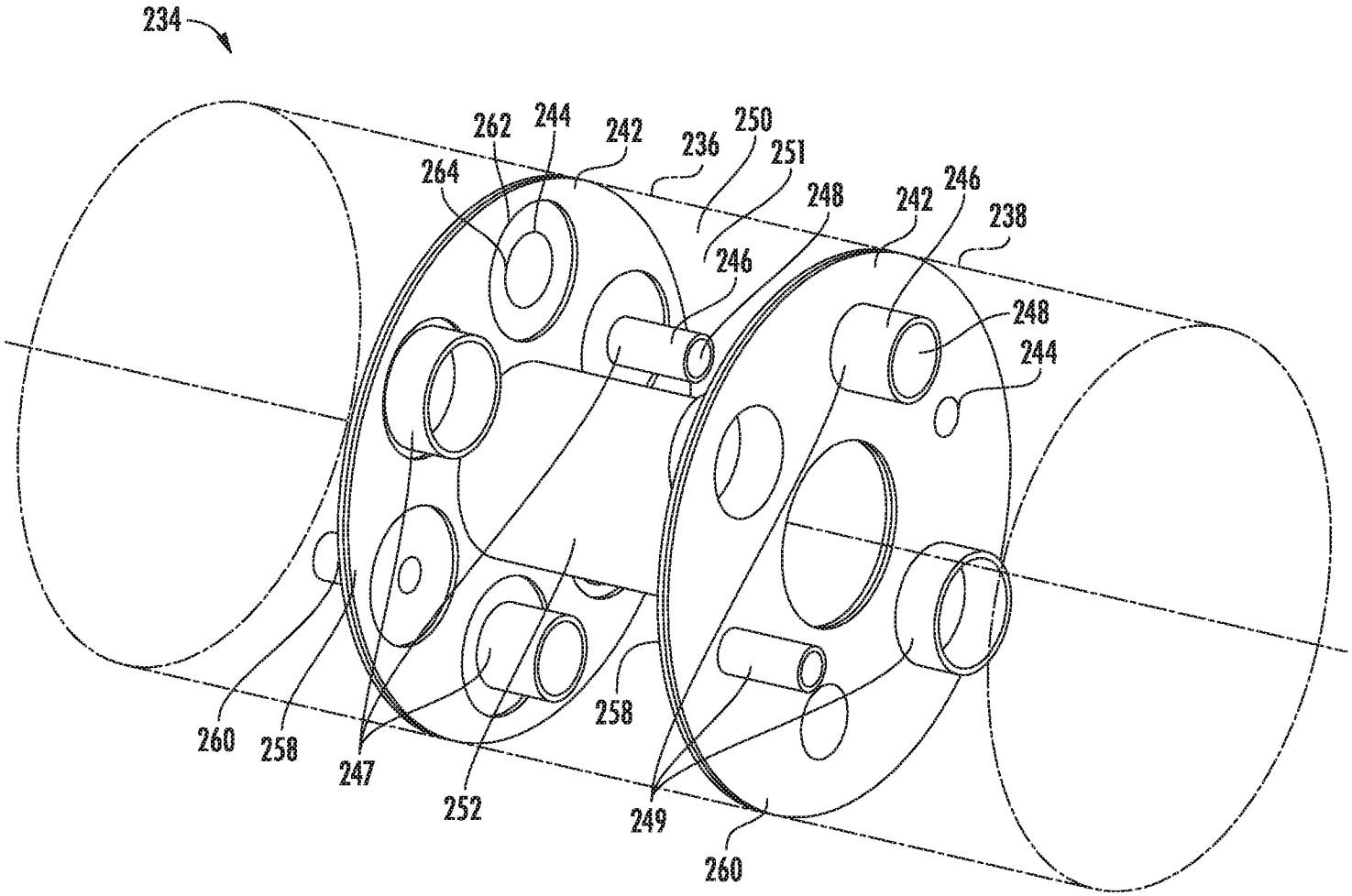
FIGS. 2A and 2B are isometric assembled and exploded views of a modular resonator assembly having a pair of headplates, each having a plurality of cutouts and a plurality of corresponding extension tubes attached thereto, according to some embodiments.
Figure 2B:
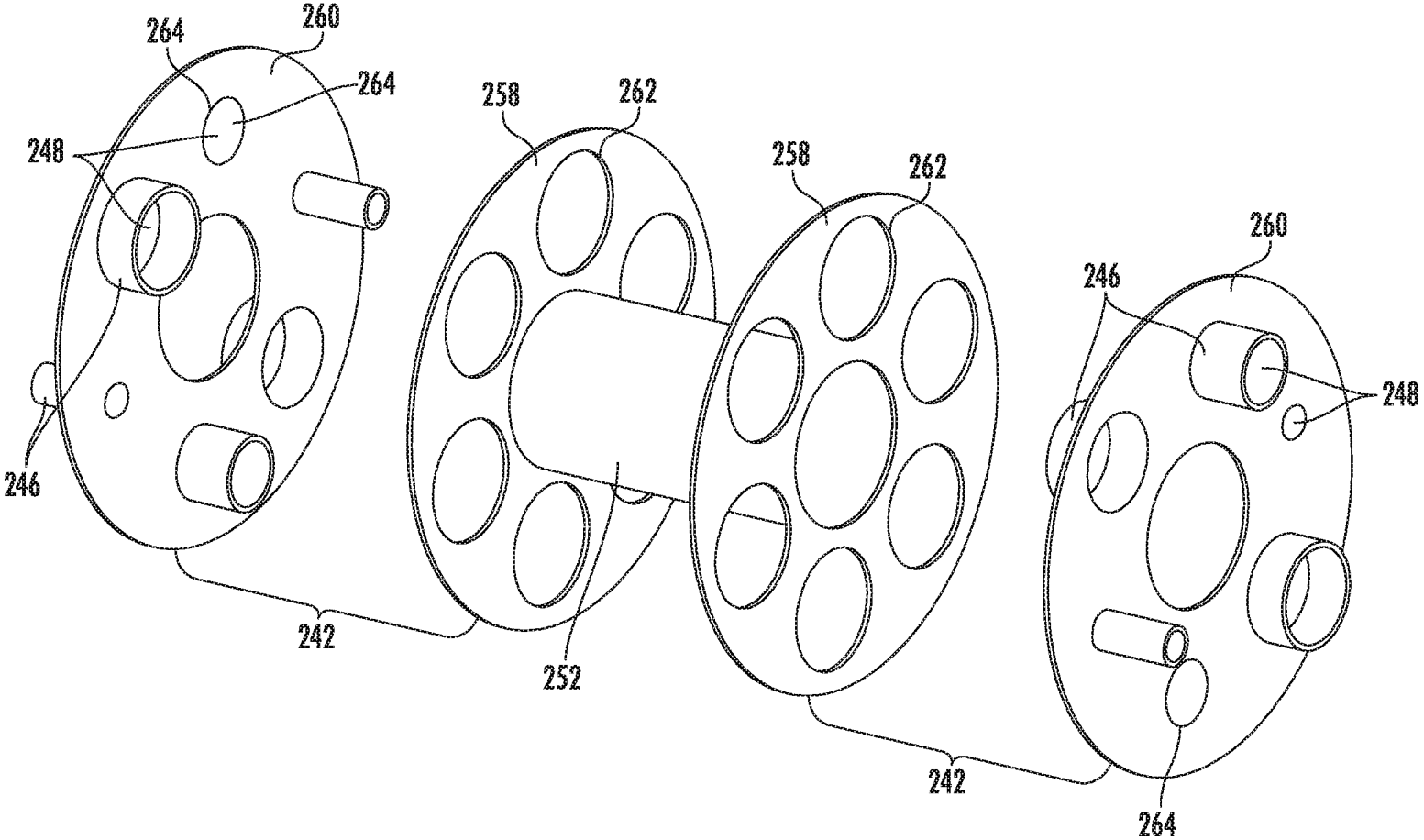

Referring now to FIGS. 2A and 2B, isometric assembled and exploded views of a modular resonator assembly 234 similar to the resonator assembly 34 of FIG. 1 are illustrated. In some embodiments, a substantially cylindrical internal cavity 250 is formed by the drum housing 238 and the head plates 242. In some embodiments, a substantially cylindrical eccentric vibration system housing 252 is disposed within the internal cavity 250 and extends between the head plates 242, forming a substantially annular internal resonator cavity 251 surrounding an eccentric vibration system (not shown). Those of ordinary skill in the art will appreciate that the eccentric vibration system housing 252 is substantially coaxial with the drum housing 238, so that the drum can independently rotate with respect to the eccentric vibration system. For example, referring back to FIG. 1, the eccentric vibration system may be coupled to a respective yoke 24, 26, and may be supported by the drum 18 via roller bearings or other suitable bearings (not shown), which support the body chassis structure 14 while allowing rotation of the drums 18 to compact the substrate 30 and propel the surface compaction machine 10.

Figure 3A:
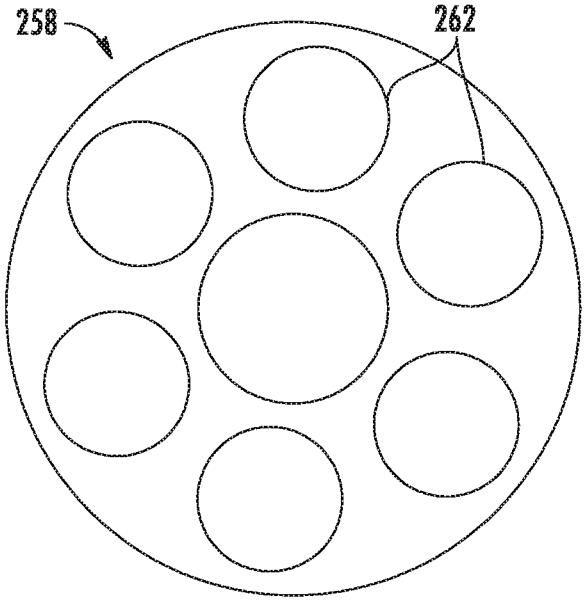
FIG. 3A is a view of a structural plate for a modular resonator assembly having a plurality of cutouts therethrough, according to some embodiments.

Referring again to FIGS. 2A and 2B, each head plate 242 includes a non-removable structural plate 258 coupled to the resonator housing 236, i.e, to the drum housing 238 and eccentric vibration system housing 252 in this embodiment. As shown in greater detail by FIG. 3A, each structural plate 258 has a plurality of structural plate cutouts 262. In this example, the structural plate cutouts 262 have uniform sizes and shapes and are arranged around the structural plate 258 in a regular pattern, but those of ordinary skill in the art will appreciate that non-uniform shapes, sizes, and/or arrangements may be used, as desired.

Figure 3B:
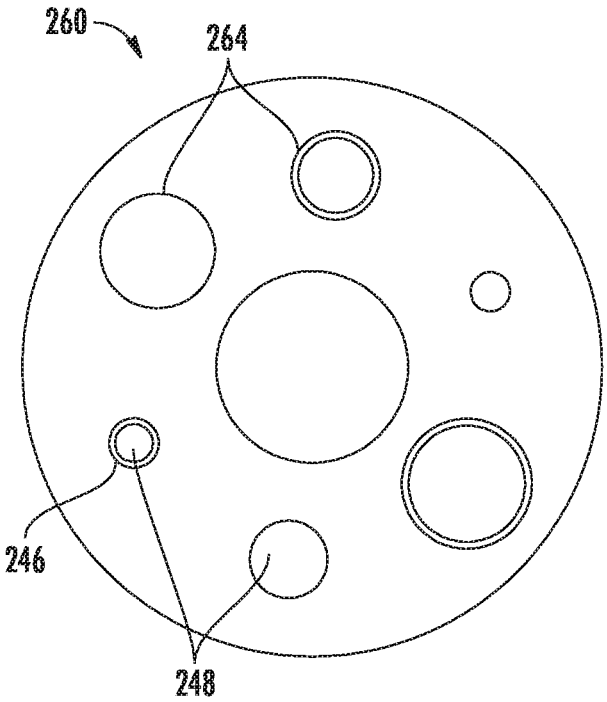
FIG. 3B is a view of modular cover plate for a modular resonator assembly that is removably coupled to the structural plate of FIG. 3A, having a plurality of differently sized cutouts therethrough, according to some embodiments.

Each head plate 242 also includes a removable cover plate 260 removably coupled to the respective structural plate 258. As shown in greater detail by FIG. 3B, each cover plate 260 has a plurality of cover plate cutouts 264, with each cover plate cutout corresponding to a structural plate cutout 262, so that each cover plate cutout 264 and corresponding structural plate cutout 262 forms one of the cutouts 244 of the resonator assembly 234.

Referring again to FIGS. 2A and 2B, each extension tube 246 is coupled to the cover plate around a corresponding cover plate cutout 264. In this example, a subset 247 of the extension tubes 246 extends into the internal cavity 250 and another subset 249 of the extension tubes 246 away from the internal cavity 250 in a straight line, in directions substantially parallel to the axis of rotation of the drum housing 238. Those of ordinary skill in the art will appreciate that some or all of the extension tubes 246 may alternatively extend along a curved path and/or in different directions, as desired.

In this example, each cover plate cutout 264 is smaller than the corresponding structural plate cutout 262, with the cover plate cutouts 264 having different sizes. Each extension tube has a cross sectional area that is substantially equal to the size of the corresponding cover plate cutout 264 (i.e., coincident with the corresponding cover plate cutout 264) so that the corresponding acoustic passage 248 has a substantially uniform cross-sectional area along its entire length. In some embodiments, the extension tubes 246 have different lengths as well. These different cross-sectional areas and/or lengths cause different frequencies and/or frequency ranges to be attenuated, and "tune" the resonator assembly 234 to reduce different types of noise.

By varying the cross-sectional areas and/or lengths of the different acoustic passages 248, the acoustic profile of the resonator assembly 234 may be selectively tuned to attenuate sound having predetermined frequencies or frequency ranges. As sound waves pass by the different extension tubes 246 and cutouts 264, the acoustic passages 248 generate a change in acoustic impedance, with the acoustic pressure of the sound waves causing certain frequencies to be drawn into the acoustic passages 248 and attenuated. The specific frequencies that are attenuated are dependent on the lengths, sizes, and/or shapes of the extension tubes 246 and cutouts 264, which allows the resonator assembly 234 to be tuned to attenuate specific frequencies. For example, the resonator assembly 234 may be tuned to attenuate noise generated by the eccentric vibration system (e.g., in the 30 Hz-80 Hz range), engine (e.g., in the 60 Hz-400 Hz range), fan (e.g., in the 300 Hz-2000 Hz range), hydraulic system (e.g., in the 200 Hz to 3000 Hz range), etc. In some embodiments, by using different cross-sectional area/length/tube combinations, the resonator assembly 234 may be tuned to attenuate broad band and/or narrow band noise frequencies more effectively.

In some embodiments, the cover plates 260 may be removed from the structural plates 258 and replaced with different cover plates (not shown) that are tuned to attenuate different frequencies or frequency ranges, e.g., by using different cover plates cutouts and/or extension tube arrangements. For example, the cover plates 260 may be coupled to the structural plates 258 using bolts (not shown) or other suitable fasteners. Alternatively, the cover plates 260 may be permanently coupled to the structural plates 258 (e.g., by welding, brazing, etc.) after they are selected, as desired.

In some embodiments, the internal cavity 250 may be empty or may include additional material for noise attenuation within the internal cavity 250. For example, acoustic absorption material may be arranged on internal surfaces within the internal cavity 250 or within individual acoustic passages 248, as desired, to increase noise attenuation further.

Advantages of the modular design of FIGS. 2A-3B may include the ability to optimize and tune the resonator configuration for individual machine models and variants, with preconfigured cover plates and extension tube arrangements for different configurations. Alternatively, or in addition, the extension tubes may be removably coupled to the cover plate, to allow further customization by selecting extension tubes having specific widths and/or lengths for different configurations. These and other features may allow common parts to be used and shared across different designs and configurations.

Figure 4:
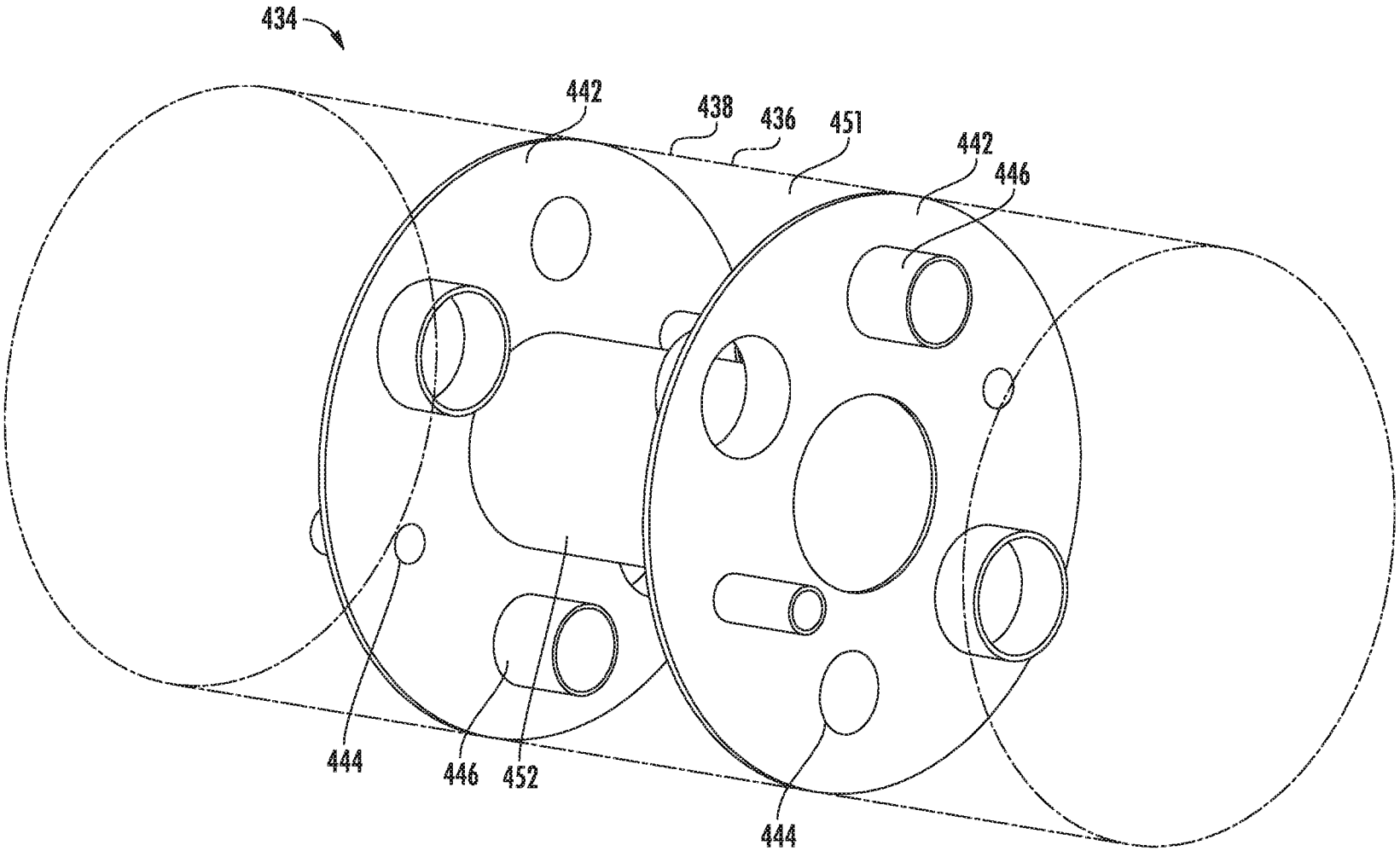
FIG. 4 is an isometric view of a resonator assembly having a pair of non-removable headplates, each having a plurality of cutouts and a plurality of corresponding extension tubes attached thereto, according to some embodiments.

In another embodiment, the head plate may be formed as a unitary structure during assembly of the drum. In this regard, FIG. 4 is an isometric view of a resonator assembly 434 having a pair of unitary, non-removable headplates 442. Similar to the embodiments described above, the resonator assembly 434 includes a resonator housing 436 composed of a drum housing 438, an eccentric vibration system housing 452, and the headplates 442. The resonator housing 436 forms a substantially annular internal resonator cavity 451, and extension tubes 446 are attached around corresponding cutouts 444 in the headplates 442, as discussed in greater detail above.

Figure 5:
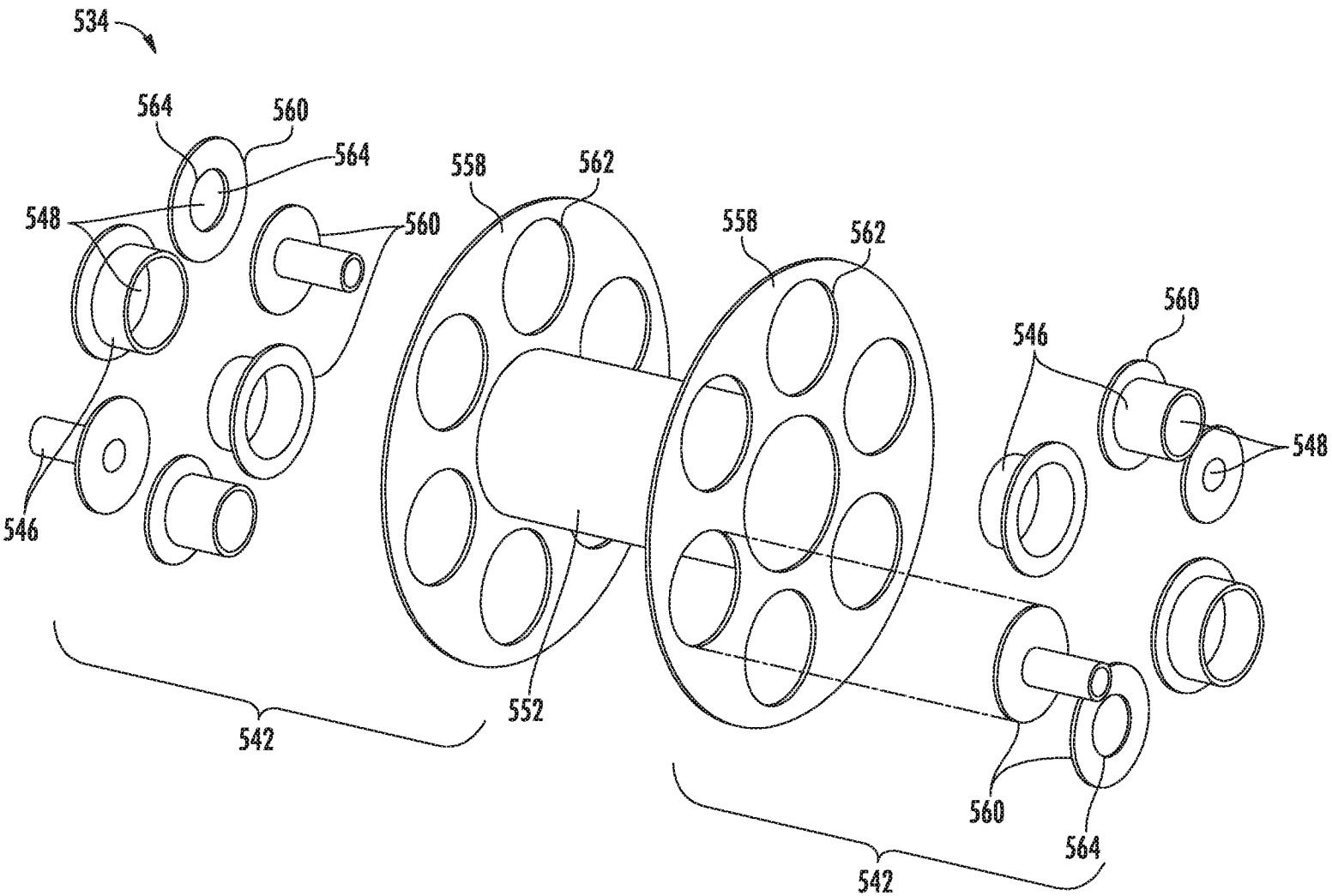
FIG. 5 is an isometric exploded view of modular resonator assembly having a pair of headplates, each having a plurality of cover plates for covering a plurality of structural plate cutouts, according to some embodiments.

In another embodiment, each head plate may include a plurality of cover plates to individually cover different structural plate cutouts. In this regard, FIG. 5 is an isometric exploded view of modular resonator assembly 534 having a pair of headplates 542, each headplate 542 having a plurality of cover plates 560 for covering a plurality of structural plate cutouts 562. Similar to the resonator assembly 234 of FIGS. 2A-2B, a cylindrical eccentric vibration housing 552 is coupled between the structural plates 558, and the structural headplates are coupled within a cylindrical drum housing (similar to the drum housing 238 of FIGS. 2A-2B).

In this example, each removable cover plate 560 includes one or more extension tubes 546 coupled thereto around respective cover plate cutouts 564. Each removable cover plate 560 is removably coupled to the structural plate 558 around a corresponding structural plate cutout 562. In this embodiment, the structural plate cutouts 562 and acoustic passages 548 are circular and are arranged coaxially in a regular pattern around the structural plate 558, but those of ordinary skill in the art will appreciate that different symmetric or non-symmetric shapes (e.g., oval, regular or irregular polygon, etc.) may be used and that the structural plate cutouts 562 and/or acoustic passages 548 may be arranged parallel or non-parallel to the axis of rotation, and/or in different regular or irregular patterns, as desired. As with other embodiments, the removable cover plates 560 may be removably coupled to the structural plate 558 (e.g., with bolts or other removable fasteners), or may be permanently attached after assembly (e.g., by welding, glue, etc.), as desired.

Figure 6A:
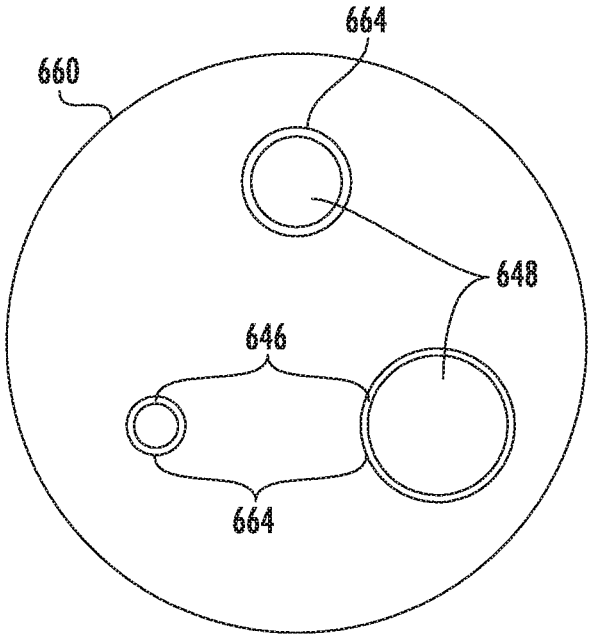
FIGS. 6A and 6B are views of cover plates that may be used interchangeably with the cover plates of FIG. 5 and other disclosed embodiments, according to some embodiments.
Figure 6B:
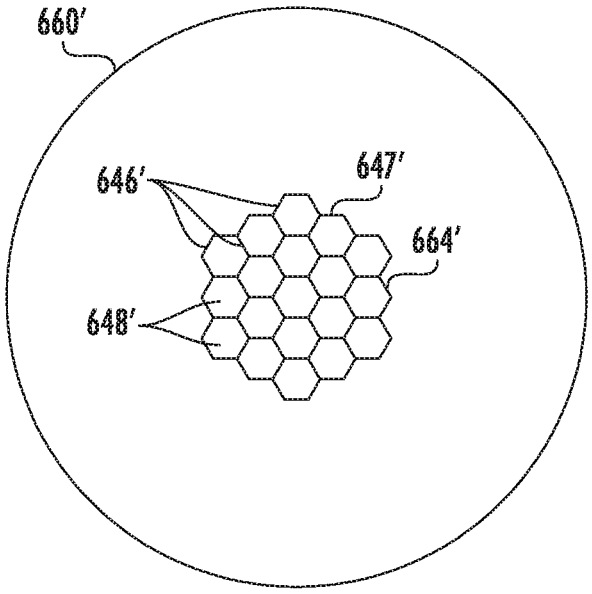

As discussed above, the cover plate cutouts 564 and extension tubes 546 may be customized in many different ways, such as by varying the size, cross-sectional area, length, shape, and other aspects to provide different acoustic properties. In this regard, FIGS. 6A and 6B illustrate additional configurations for cover plates 660 that may be used interchangeably with the cover plates 560 of FIG. 5, and with other embodiments disclosed herein. FIG. 6A illustrates a cover plate 660 that includes multiple cover plate cutouts 664 and extension tubes 646 on each cover plate, which allows the total number of acoustic passages 648 to be increased, thereby allowing further customization of the acoustic properties of the resonator. FIG. 6B illustrates a cover plate 660' that includes a cover plate cutout 664' sized to correspond to a cluster 647' of hexagonal extension tubes 646' forming hexagonal acoustic passages 648' arranged in a honeycomb pattern, which may provide unique acoustic properties for the resonator as well. As discussed above, these and other configurations can be customized and combined in different ways, as desired, to optimize the desired acoustic properties for the resonator.

These and other embodiments may have several advantages. For example, by reducing unwanted noise, an eccentric vibration system can operate at higher vibration amplitudes and speeds allowing for a more efficient compaction process, including in markets that have stricter noise regulations, such as urban markets. This reduction in noise exposure to machine operators and jobsite workers may reduce the danger to workers and lessen the hearing protection requirements to safely operate these machines. Other components, such as engine and hydraulic system fans, may also be operated at higher speeds, which may enable operation in more extreme environments (e.g., high altitude, extreme temperature, etc.).

When an element is referred to as being "connected", "coupled", "responsive", "mounted", or variants thereof to another element, it can be directly connected, coupled, responsive, or mounted to the other element or intervening elements may be present. In contrast, when an element is referred to as being "directly connected", "directly coupled", "directly responsive", "directly mounted" or variants thereof to another element, there are no intervening elements present. Like numbers refer to like elements throughout. As used herein, the singular forms "a", "an" and "the" are intended to include the plural forms as well, unless the context clearly indicates otherwise. Well-known functions or constructions may not be described in detail for brevity and/or clarity. The term "and/or" and its abbreviation "/" include any and all combinations of one or more of the associated listed items.

It will be understood that although the terms first, second, third, etc. may be used herein to describe various elements/operations, these elements/operations should not be limited by these terms. These terms are only used to distinguish one element/operation from another element/operation. Thus, a first element/operation in some embodiments could be termed a second element/operation in other embodiments without departing from the teachings of present inventive concepts. The same reference numerals or the same reference designators denote the same or similar elements throughout the specification.

As used herein, the terms "comprise", "comprising", "comprises", "include", "including", "includes", "have", "has", "having", or variants thereof are open-ended, and include one or more stated features, integers, elements, steps, components or functions but do not preclude the presence or addition of one or more other features, integers, elements, steps, components, functions or groups thereof. Furthermore, as used herein, the common abbreviation "e.g.", which derives from the Latin phrase "exempli gratia," may be used to introduce or specify a general example or examples of a previously mentioned item, and is not intended to be limiting of such item. The common abbreviation "i.e.", which derives from the Latin phrase "id est," may be used to specify a particular item from a more general recitation.

Persons skilled in the art will recognize that certain elements of the above-described embodiments may variously be combined or eliminated to create further embodiments, and such further embodiments fall within the scope and teachings of inventive concepts. It will also be apparent to those of ordinary skill in the art that the above-described embodiments may be combined in whole or in part to create additional embodiments within the scope and teachings of inventive concepts. Thus, although specific embodiments of, and examples for, inventive concepts are described herein for illustrative purposes, various equivalent modifications are possible within the scope of inventive concepts, as those skilled in the relevant art will recognize. Accordingly, the scope of inventive concepts is determined from the appended claims and equivalents thereof.

The invention claimed is:

1. A resonator assembly for a surface compaction machine comprising:

a resonator housing defining an internal cavity, the resonator housing comprising a first head plate comprising a plurality of first cutouts and a second head plat opposite the first head plat, the second head plate comprising a plurality of second cutouts; and a plurality of first extension tubes, each first extension tube of the plurality of first extension tubes coupled to the first head plate around a corresponding first cutout, each first cutout forming an acoustic passage between the internal cavity and an exterior of the resonator housing to attenuate sound around the internal cavity;

a drum housing comprising a substantially cylindrical compaction surface surrounding the first head plate and the second head plate, the internal cavity comprising a substantially cylindrical cavity defined by the first head plate, the second head plate, and the drum housing; and an eccentric vibration system housing for enclosing an eccentric vibration system, the internal cavity surrounding the eccentric vibration system.

2. The resonator assembly of claim 1, wherein the resonator housing further comprises:

a plurality of second extension tubes, each second extension tube of the plurality of second extension tubes coupled to the second head plate around a corresponding second cutout.

3. The resonator assembly of claim 1, wherein at least two first cutouts of the plurality of first cutouts have different sizes.

4. The resonator assembly of claim 3, wherein each first extension tube of the plurality of first extension tubes has a cross-sectional area substantially equal to the size of the first cutout corresponding to the first extension tube.

5. The resonator assembly of claim 1, wherein at least two first extension tubes of the plurality of first extension tubes have different lengths.

6. The resonator assembly of claim 1, wherein a first subset of the plurality of first extension tubes extends into the internal cavity in a first direction, and wherein a second subset of the plurality of first extension tubes extends away from the internal cavity in a second direction.

7. The resonator assembly of claim 1, wherein the first head plate comprises:

a non-removable structural plate coupled to the resonator housing; and a removable cover plate removably coupled to the structural plate.

8. The resonator assembly of claim 7, wherein each first cutout comprises:

a structural plate cutout; and a corresponding cover plate cutout that is smaller than the structural plate cutout, wherein each first extension tube has a cross sectional area that is substantially coincident with the cover plate cutout corresponding to the first extension tube.

9. The resonator assembly of claim 8, wherein each first extension tube of the plurality of first extension tubes is coupled to the cover plate around the cover plate cutout corresponding to first extension tube.

10. The resonator of claim 7, wherein the removable cover plate comprises a plurality of removable cover plates, and wherein each removable cover plate is removably coupled to the structural plate around a corresponding structural plate cutout.

11. The resonator assembly of claim 1, wherein the internal cavity, the first cutouts and the first extension tubes are sized to attenuate sound in one or more predetermined frequency ranges.

12. The resonator assembly of claim 11, wherein the predetermined frequency range is between 30 Hz and 80 Hz.

13. A drum assembly for a surface compaction machine comprising:

a substantially cylindrical drum housing comprising an external compaction surface and an internal surface opposite the external compaction surface;

a first head plate coupled to the internal surface of the drum housing;

a second head plate coupled to the internal surface of the drum housing;

an eccentric vibration system housing coupled between the first head plate and the second head plate, wherein the compaction surface, the first head plate, the second head plate, and the eccentric vibration system housing form a substantially annular internal resonator cavity;

a plurality of cutouts in the first head plate and the second head plate; and a plurality of extension tubes coupled to the first head plate and the second head plate, wherein each extension tube is coupled around a corresponding cutout to form an acoustic passage between the internal resonator cavity to attenuate sound around the internal resonator cavity.

14. The drum assembly of claim 13, wherein at least two cutouts of the plurality of cutouts have different sizes.

15. The drum assembly of claim 14, wherein each extension tube of the plurality of extension tubes has a cross-sectional area substantially equal to the size of the cutout corresponding to the extension tube.

16. The drum assembly of claim 13, wherein at least two extension tubes of the plurality of extension tubes have different lengths.

17. The drum assembly of claim 13, wherein a first subset of the plurality of extension tubes extends into the internal cavity, and wherein a second subset of the plurality of extension tubes extends away from the internal cavity.

18. The drum assembly of claim 13, wherein the first head plate comprises:

a non-removable first structural plate coupled to the drum housing and the eccentric vibration system housing; and a removable first cover plate removably coupled to the first structural plate, and wherein the second head plate comprises:

a non-removable second structural plate coupled to the drum housing and the eccentric vibration system housing; and a removable second cover plate removably coupled to the second structural plate.

19. The drum assembly of claim 13, wherein the internal resonator cavity, the cutouts and the extension tubes are sized to attenuate sound in one or more predetermined frequency ranges.

20. The drum assembly of claim 17, wherein the predetermined frequency range is between 30 Hz and 80 Hz.

* * * * *